US005867096A

United States Patent [19]

Park

[11] Patent Number: 5,867,096

[45] Date of Patent: Feb. 2, 1999

[54] METHOD FOR SIGNAL DEGRADATION ALARM DETECTION AND CANCELLATION IN SYNCHRONOUS DIGITAL MICROWAVE SYSTEM

[75] Inventor: Woon-Shin Park, Seoul, Rep. of Korea

[73] Assignee: SamSung Electronics Co., Ltd., Suwon, Rep. of Korea

[21] Appl. No.: 736,043

[22] Filed: Oct. 21, 1996

[30] Foreign Application Priority Data

Oct. 20, 1995 [KR] Rep. of Korea ..... 1995/36342

[51] Int. Cl.[6] ..... G08B 29/00

[52] U.S. Cl. ..... 340/507; 340/825.16; 395/183.01; 364/184

[58] Field of Search ..... 340/505–507, 340/525, 825.06–825.16; 364/184, 188, 138, 140, 146; 395/183.01, 183.18, 183.19, 183.2, 184.01, 180

[56] References Cited

U.S. PATENT DOCUMENTS

| | | | |
|---|---|---|---|
| 4,249,166 | 2/1981 | Schultz | 340/506 |
| 4,446,462 | 5/1984 | Ouellette et al. | 340/825.07 |
| 5,212,475 | 5/1993 | Thoma | 340/825.16 |
| 5,214,577 | 5/1993 | Sztipanovits et al. | 364/184 |
| 5,309,448 | 5/1994 | Bouloutas et al. | 395/183.01 |
| 5,323,145 | 6/1994 | Simmering | 340/825.16 |
| 5,408,218 | 4/1995 | Svedberg et al. | 340/507 |
| 5,508,690 | 4/1996 | Shur et al. | 340/825.16 |

*Primary Examiner*—Donnie L. Crosland
*Attorney, Agent, or Firm*—Robert E. Bushnell, Esq.

[57] ABSTRACT

A method for signal degradation alarm detection in a digital microwave system, includes the steps of: summing code violation values from cells of a given buffer except for one of the cells currently indicated in the given buffer to calculate a code violation sum value of a corresponding provision, and setting a code violation limit value to a previously defined value; comparing the code violation sum value with the code violation limit value; setting a signal degradation alarm flag to detect an alarm when the code violation sum value is greater than or equal to the code violation limit value; adding the code violation sum value to a next code violation sum value of a lower buffer to obtain a new code violation sum value when the code violation sum value is less than the code violation limit value; setting the signal degradation alarm flag to detect the alarm when the new code violation sum value is greater than or equal to the code violation limit value; and ending performance of the method without setting the signal degradation alarm flag when a final code violation sum value corresponding to a lowermost buffer is less than the code violation limit value.

33 Claims, 13 Drawing Sheets

SD ALARM DETECTING ROUTINE

600
PROVISION ?
NO
YES
602
DETECTION BER=10E_9 ?
NO
A
YES
S=S1(e9)
L=L(e9)
604
606
S ≧ L ?
YES
NO
S=S+S2(e8)
608
610
S ≧ L ?
YES
NO
S=S+S2(e7)
612
614
S ≧ L ?
YES
NO
S=S+S2(e6)
616
618
S ≧ L ?
YES
NO
S=S+S2(e5)
620
622
S ≧ L ?
YES
E
NO
624
SETTING SD ALARM FLAG
RETURN

METHOD FOR SIGNAL DEGRADATION ALARM DETECTION AND CANCELLATION IN SYNCHRONOUS DIGITAL MICROWAVE SYSTEM

CROSS REFERENCE TO RELATED APPLICATIONS

This application makes reference to, incorporates the same herein, and claims all benefits accruing under 35 U.S.C. §119 from an application for *Method For Signal Degradation Alarm Detection And Cancellation In Synchronous Digital Microwave System* earlier filed in the Korean Industrial Property Office on 20 Oct. 1995 and there duly assigned Ser. No. 36342/1995.

BACKGROUND OF THE INVENTION

The present invention relates to a synchronous digital microwave system, and more particularly, to a method for a signal degradation (SD) alarm detection and cancellation according to a collection of code violation (CV) values.

Communications systems have increased dramatically in size and complexity in recent years. These increases present serious problems in regard to system management and control. One aspect of system management is fault management, and an essential component of fault management is fault identification. The prior art has addressed the problem of fault management in communication systems in, for example, U.S. Pat. No. 5,309,448 entitled *Methods And Systems For Alarm Correlation And Fault Localization In Communication Networks* issued to Bouloutas et al. In Bouloutas et al. '448, several specific processing algorithms are provided for solving alarm correlation and fault localization problems in a communication network.

In a synchronous digital microwave system, a monitoring controller should be designed to have the function of performing the operation, management, maintenance and repair of the system. In contemplating the design of a controller capable of managing a digital microwave system, however, I note that a problem of excess memory consumption exists. Accordingly, I believe that an improved method for detecting signal degradation in a digital microwave system is in need.

SUMMARY OF THE INVENTION

Accordingly, it is an object of the present invention to provide a method for performing signal degradation (SD) alarm detection and cancellation in a digital microwave system with reduced memory consumption.

It is another object to provide a method for performing a signal degradation (SD) alarm detection and cancellation that utilizes only ten buffer cells for each provision specified by an operator.

It is still another object to provide a method for managing a database to which the code violation (CV) values are continuously accumulated according to a given time period.

It is yet another object to provide a method for checking for signal degradation (SD) alarm detection and cancellation.

To achieve these and other objects, the present invention provides a method for signal degradation alarm detection and cancellation in a digital microwave system. The method begins by performing an interrupt every minimum period defined in a provision to store code violation values detected from tributary units in first buffers every minimum period. When the first buffers are filled with the code violation values, the code violation values are summed to obtain first code violation sum values and the first code violation sum values are stored in second buffers. Each one of the first code violation sum values is obtained according to a first time period equal to a first integer multiple of the minimum period. When the second buffers are filled with the first code violation sum values, the first code violation sum values are summed to obtain second code violation sum values and the second code violation sum values are stored in third buffers. Each one of the second code violation sum values is obtained according to a second time period equal to a second integer multiple of the minimum period. When the third buffers are filled with the second code violation sum values, the second code violation sum values are summed to obtain third code violation sum values and the third code violation sum values are stored in fourth buffers. Each one of the third code violation sum values is obtained according to a third time period equal to a third integer multiple of the minimum period. When the fourth buffers are filled with the third code violation sum values, the third code violation sum values are summed to obtain fourth code violation sum values and the fourth code violation sum values are stored in fifth buffers. Each one of the fourth code violation sum values is obtained according to a fourth time period equal to a fourth integer multiple of the minimum period. When the fifth buffers are filled with the fourth code violation sum values, the fourth code violation sum values are summed to obtain fifth code violation sum values and the fifth code violation sum values are stored in sixth buffers. Each one of the fifth code violation sum values is obtained according to a fifth time period equal to a fifth integer multiple of the minimum period. Signal degradation alarm detection and cancellation is performed by comparing modified sum values generated from the first, second, third, fourth and fifth code violation sum values with a predetermined limit value.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
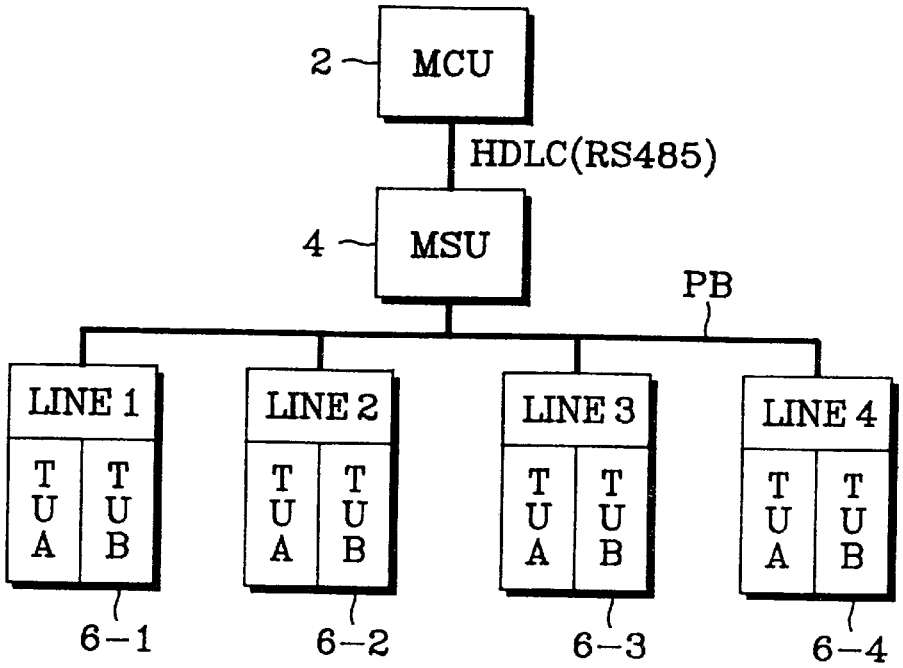
FIG. 1 is a block diagram illustrating a configuration for performing signal degradation (SD) alarm detection and cancellation in a synchronous digital microwave system constructed according to the principles of the present invention.

Turning now to the drawings and referring to FIG. 1, a block diagram illustrating a configuration for performing signal degradation (SD) alarm detection and cancellation in a synchronous digital microwave system constructed according to the principles of the present invention is shown.

In FIG. 1, a main control unit (MCU) 2 is connected to a monitoring and switching unit (MSU) 4, and the monitoring and switching unit (MSU) 4 is connected to tributary units (TUs) 6-1, 6-2, 6-3 and 6-4 via a parallel bus (PB). Tributary units (TUs) 6-1, 6-2, 6-3 and 6-4 are each doubled; that is, tributary units (TUs) 6-1, 6-2, 6-3 and 6-4 each comprise a tributary unit A and a tributary unit B.

Monitoring and switching unit (MSU) 4 collects code violation (CV) values from the respective tributary unit (TU) 6-1, 6-2, 6-3 and 6-4, to thereby determine whether a signal degradation (SD) alarm is detected or cancelled. Code violation (CV) values are values calculated by a bit interleaved parity-24 (BIP-24) technique. Monitoring and switching unit (MSU) 4 reports the result of its determination to main control unit (MCU) 2 according to an alarm reporting protocol. Main control unit (MCU) 2 operates according to a provision indicating detection limit values of a signal degradation (SD) alarm set by an operator (i.e., user). In the synchronous digital microwave system of the present invention, the term "provision" represents times, mode settings, and the above-mentioned detection limit values of the signal degradation (SD) alarm set by the operator. The provision is set by the operator according to the environment where the system is operated, and the provision is stored to a random access memory (RAM) of the system. It should be noted that the system is initialized with the content of the random access memory (RAM) designated by the operator. The provision is recommended by the International Telecommunications Union-Telecommunications (ITU-T).

Figure 2:
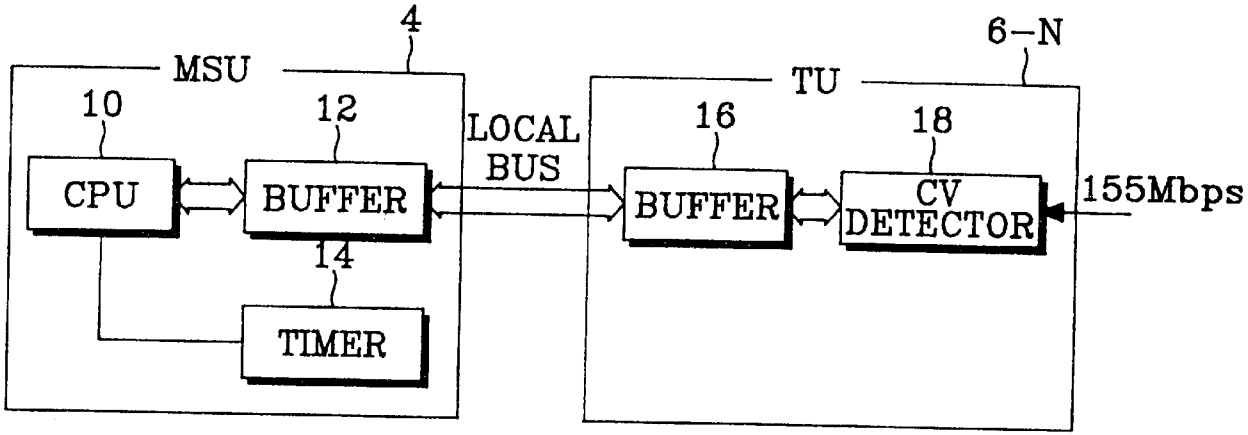
FIG. 2 is a block diagram illustrating additional details of the configuration shown in FIG. 1.

FIG. 2 is a block diagram illustrating additional details of the configuration shown in FIG. 1. In particular, FIG. 2 illustrates the internal construction of monitoring and switching unit (MSU) 4 and an exemplary tributary unit (TU) 6-N. Monitoring and switching unit (MSU) 4 is comprised of a central processing unit (CPU) 10, a buffer 12 and a timer 14. The exemplary tributary unit (TU) 6-N is comprised of a buffer 16 and a code violation (CV) detector 18. Monitoring and switching unit (MSU) 4 and tributary unit (TU) 6-N are connected to each other via a local bus. Monitoring and switching unit (MSU) 4 collects code violation (CV) values from the exemplary tributary unit (TU) 6-N through the local bus according to a given time period. Timer 14 is designed to perform a polling of the tributary unit (TU) 6-N every given time period. Buffers 12 and 16 temporarily store the code violation (CV) values.

In the configuration of FIGS. 1 and 2, signal degradation (SD) alarm detection and cancellation based on collected code violation (CV) values is performed according to a protocol of the International Telecommunications Union-Telecommunications (ITU-T) as in the following Table 1.

Table 1 shows limit values of a bit error rate (BER) and an detection/cancellation time corresponding to detection and cancellation bit error rates (BERs) designated by the operator in the provision.

TABLE 1

| provision (detection BER) | detection time | defined BER | provision (cancellation BER) | cancellation time | defined BER |
|---|---|---|---|---|---|
| 10E-5 | 1 sec | 492 × 3 = 1476 | 10E-6 | 10 sec | 510 × 3 = 1530 |
| 10E-6 | 10 sec | 510 × 3 = 1530 | 10E-7 | 100 sec | 512 × 3 = 1536 |
| 10E-7 | 100 sec | 512 × 3 = 1536 | 10E-8 | 1000 sec | 512 × 3 = 1536 |
| 10E-8 | 1000 sec | 512 × 3 = 1536 | 10E-9 | 10000 sec | 512 × 3 = 1536 |
| 10E-9 | 10000 sec | 512 × 3 = 1536 | 10E-10 | 100000 sec | 512 × 3 = 1536 |

In Table 1, 10E-5, 10E-6, . . . and 10E-10 represent $10^{-5}$, $10^{-6}$, . . . $10^{-10}$, respectively. That is, a bit error rate (BER) of 10E-5 indicates that one code violation (CV) is generated among $10^5$ bits of code data.

Monitoring and switching unit (MSU) 4 detections the signal degradation (SD) alarm when a code violation (CV) value indicates that a bit error rate (BER) greater than an detection bit error rate (BER) occurs within a given detection time. Similarly, monitoring and switching unit (MSU) 4 cancels the signal degradation (SD) alarm when a code violation (CV) value indicates that a bit error rate (BER) less than a cancellation bit error rate (BER) occurs within a given cancellation time, according to the provision of Table 1.

There has been a problem in that too much memory is needed to detect one signal degradation (SD) alarm, since more than 100,000 buffer cells are utilized every 1 second period to perform the signal degradation (SD) alarm detection for all provisions.

Figure 3:
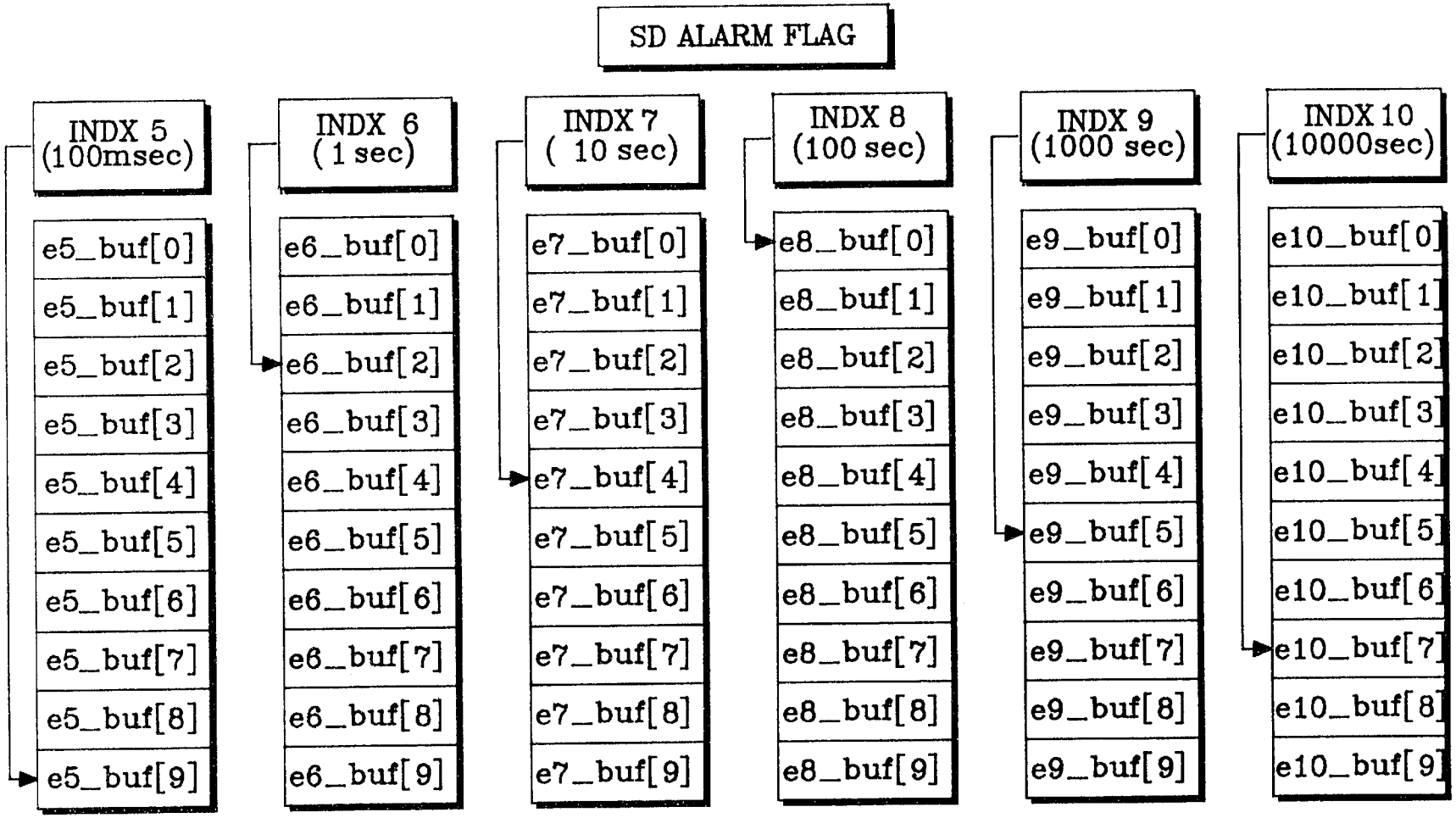
FIG. 3 is a block diagram illustrating a database of the monitoring and switching unit (MSU) 4 shown in FIG. 1.

Referring now to FIG. 3, a block diagram illustrating a database of the monitoring and switching unit (MSU) 4 of FIG. 1 is shown. This database is within a random access memory (RAM) of the monitoring and switching unit (MSU) 4. The database of FIG. 3 includes a one byte register for a signal degradation (SD) alarm flag, and six one byte index registers (INDX 5 to INDX 10). That is, index registers INDX5, IDX6, INDX7, INDX8, INDX9 and MIDX10 can each store one byte of data. Each index register (INDX) includes a code violation (CV) array buffer having a plurality of individual buffer cells. The signal degradation (SD) alarm flag is set when the signal degradation (SD) alarm is detected, and the signal degradation (SD) alarm flag is reset when the signal degradation (SD) alarm is cancelled. The value exhibited by a given index register (INDX) represents the buffer cell within the code violation (CV) array buffer of a corresponding provision, to which current code violation (CV) values are stored. The value exhibited by a given buffer cell of a code violation (CV) array buffer is increased by one as a new code violation (CV) value is accumulated. The code violation (CV) array buffers include e5_buf, e6_buf, e7_buf, e8_buf, e9_buf and e10_buf The buffers e5_buf, e6_buf, e7_buf, e8_buf and e9_buf correspond to respective provisions, and buffer e10_buf is used for checking a cancellation condition according to the time of the 10E-9 provision. The buffer cells of the code violation (CV) array buffers each store a corresponding code violation (CV) value.

One key characteristic of the database of FIG. 3 is that it includes only 10 buffer cells (total buffer cells=10×6) for each respective provision. This characteristic has the effect of greatly reducing memory consumption.

The database of FIG. 3 is used to perform signal degradation (SD) alarm detection and cancellation according to the signal degradation (SD) provision in response to a request from main control unit (MCU) 2. As disclosed in Table 1, the provision 10E-5 requires the highest degree of speed and the monitoring and switching unit (MSU) 4 collects and processes code violation (CV) values every 100 milliseconds for satisfying this requirement.

Figure 8:
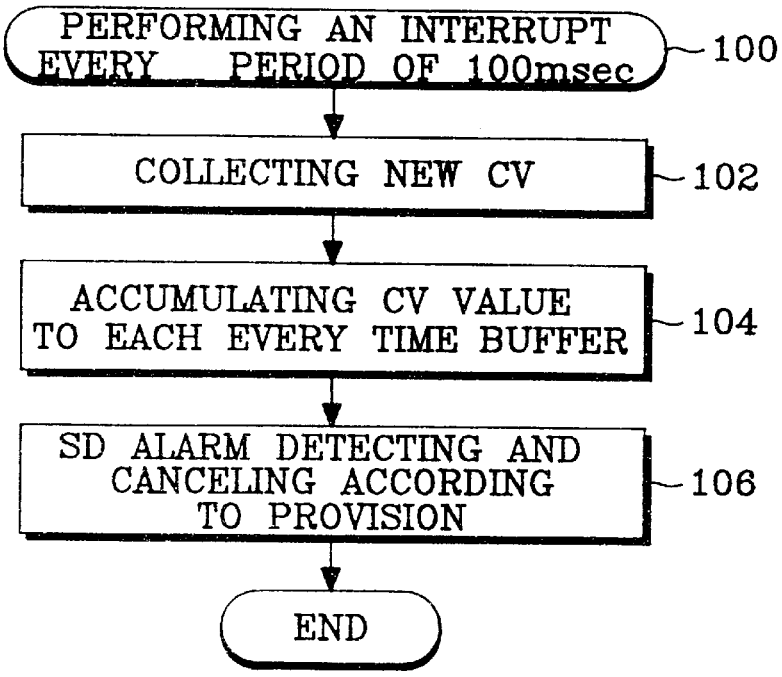
FIG. 8 is a flow chart illustrating the overall method of the present invention.

FIG. 8 is a flow chart illustrating the overall method of the present invention. This method is performed essentially by the monitoring and switching unit (MSU) 4 of FIG. 2. In step 100, an interrupt is generated every 100 milliseconds by the timer 14. In step 102, new code violation (CV) values are collected in response to the interrupt. In step 104, the code violation (CV) values are stored in respective code violation (CV) array buffers of the database illustrated in FIG. 3. Then, in step 106, signal degradation (SD) alarm detection and cancellation is performed according to the provision provided by main control unit (MCU) 2.

Figure 4A:
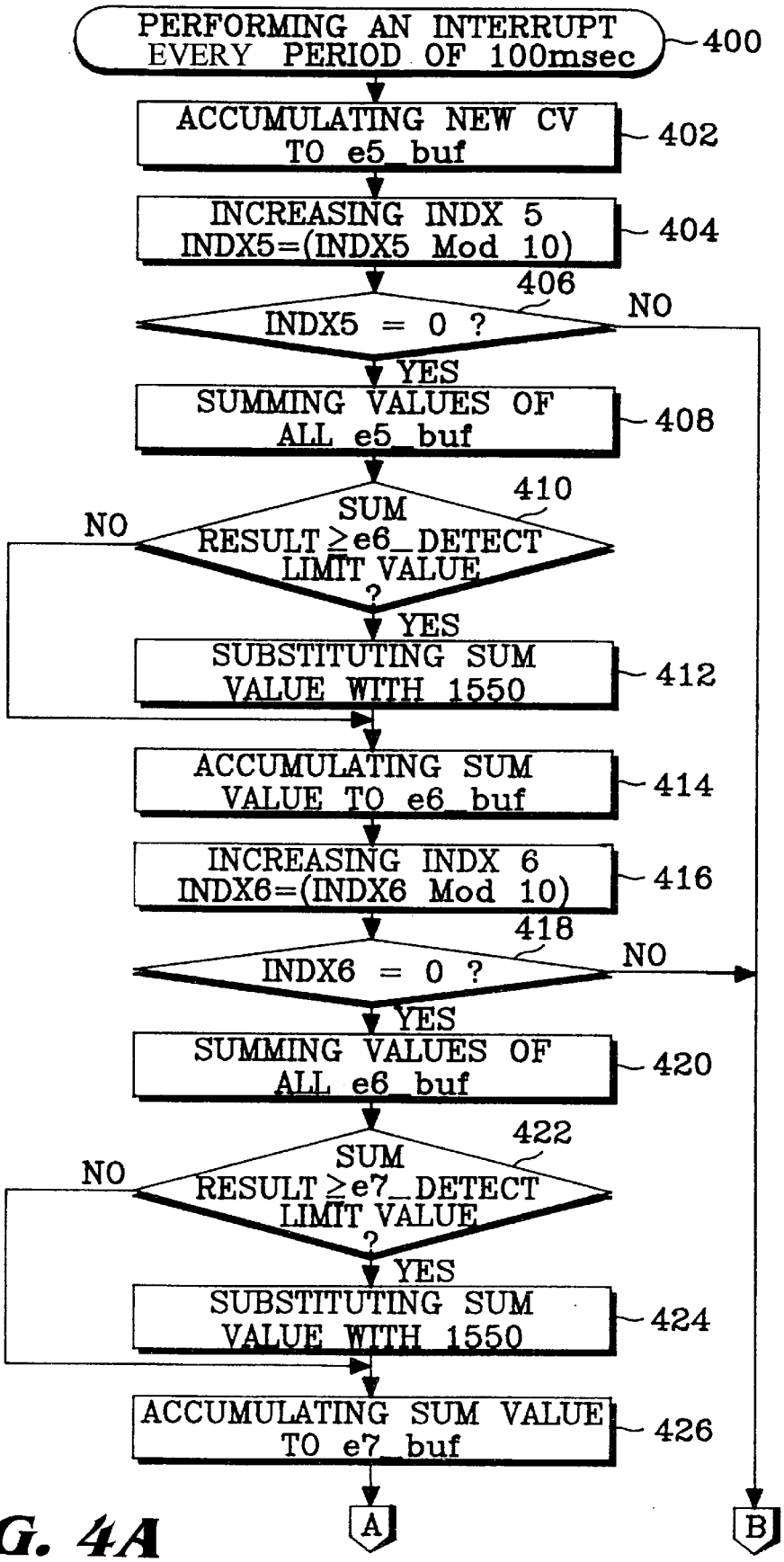
FIGS. 4A through 4C are a flow chart illustrating the steps for collecting code violation (CV) values according to the principles of the present invention.
Figure 4B:
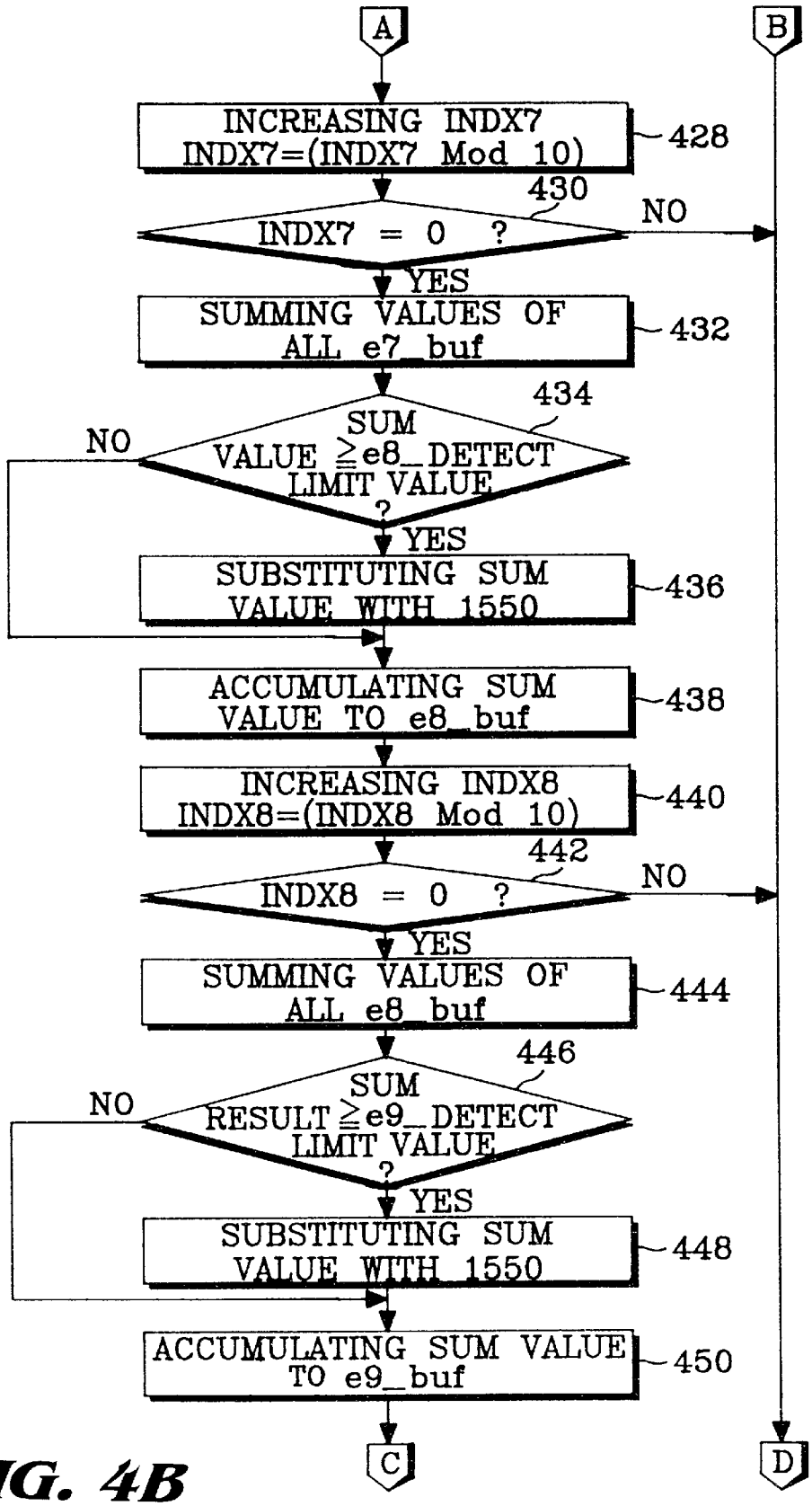
Figure 4C:
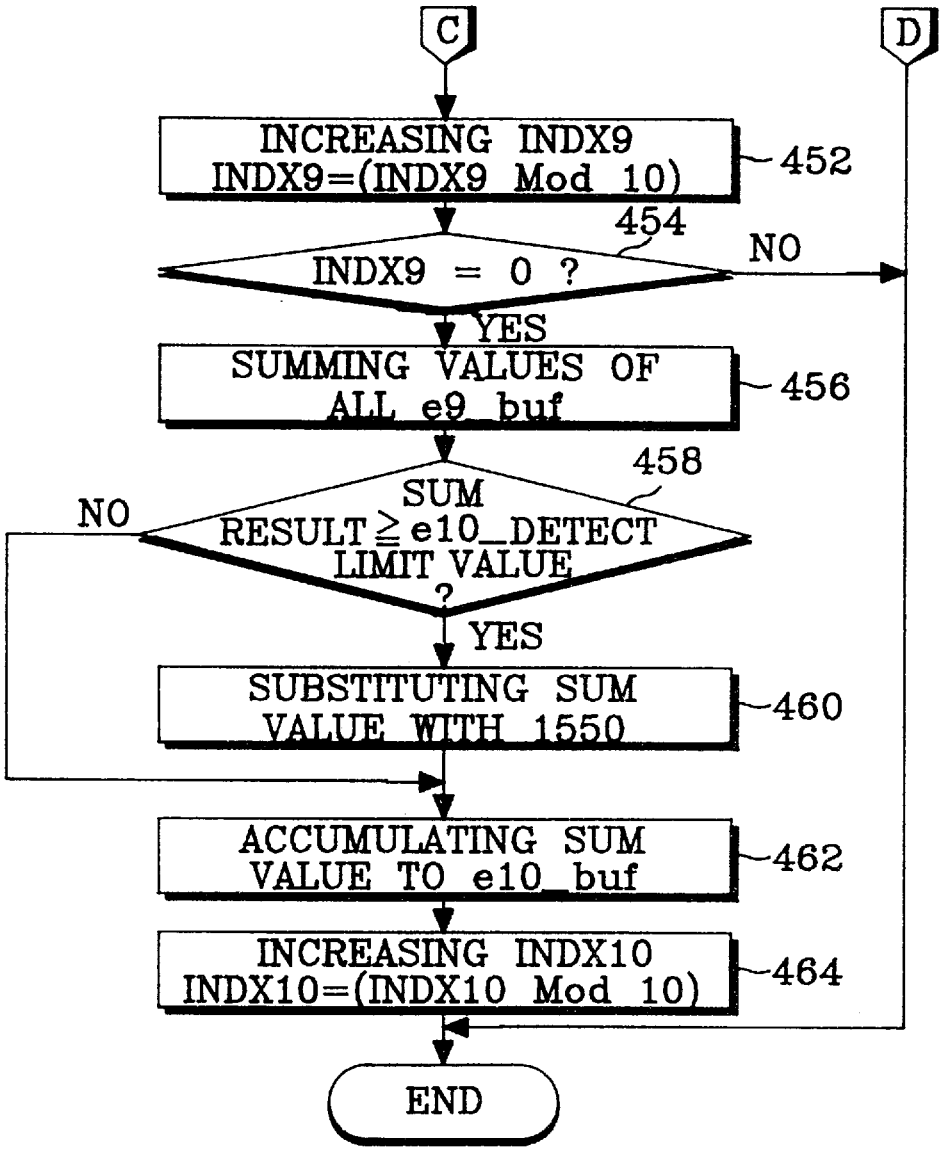

FIGS. 4A through 4C are a flow chart illustrating the steps for collecting code violation (CV) values according to the principles of the present invention. The flow chart of FIGS. 4A through 4C correspond to steps 102 and 104 of FIG. 8. A detailed description of the steps of FIGS. 4A through 4C will now be provided with reference to FIGS. 2 and 3.

Central processing unit (CPU) 10 of the monitoring and switching unit (MSU) 4 shown in FIG. 2 performs step 402 in response to the interrupt generated every 100 milliseconds by the timer 14 in step 400. First, central processing unit (CPU) 10 accumulates the new code violation (CV) generated from the tributary unit (TU), to the buffer e5_buf[0] among the code violation (CV) array buffers e5_buf[i] (i=0 to 9) in step 402. Then, in step 404, the index register 'INDX 5 is increased by one, and an integer remainder after the decimal point (shown as 'INDX 5 Mod 10' in the drawing) obtained by dividing the INDX 5 by 10 is set to the index register INDX 5. In step 406, it is determined whether the INDX 5 is equal to 0. The 'INDX 5=0' condition represents that all code violation (CV) values are respectively accumulated to the code violation (CV) array buffers e5_buf[i] (i=0 to 9). Accordingly, if INDX 5 is not equal to 0, in steps 400 to 404, the new code violation (CV) values are accumulated every 100 milliseconds in a sequence of the code violation (CV) array buffers e5_buf[0], e5_buf[1], e5_buf [2], . . . , e5_buf[9].

When the INDX 5 is equal to 0 in step 406, that is, when the code violation (CV) values are accumulated up to the buffer e5_buf[9], central processing unit (CPU) 10 sums up all code violation (CV) values accumulated to the code violation (CV) array buffer e5_buf[i] (i=0 to 9), in step 408. Central processing unit (CPU) 10 then determines whether the sum result is greater than or equal to a predetermined e6_detect limit value. If the sum result is greater than or equal to the predetermined e6_detect limit value, the sum value is substituted with the value '1550' in step 412, and then the substituted sum value is accumulated to the upper code violation (CV) array buffer e6_buf[0] among e6_buf [i] (i=0 to 9) in step 414. As described above, it is to fundamentally eliminate an overflow of the buffer that the sum value is substituted with the value '1550' and the substituted sum value is accumulated when the bit error rate (BER) having the sum value of a lower code violation (CV) array buffer larger than or equal to the detect limit value of an upper provision is generated. It can be appreciated from Table 1 whether the value '1550' corresponds to the detect limit value of the upper provision. It can be easily appreciated that the value '1550' is appropriate for satisfying the defined numbers of the detection bit error rate (BER) since numbers of the detection bit error rate (BER) defined in Table 1 are from '1476' to '1536'.

However, if the sum value is less than the predetermined e6_detect limit value in step 410, step 414 is performed without step 412. In step 414, the sum value is accumulated to the upper code violation (CV) array buffer e6_buf[0]. Then, in step 416, central processing unit (CPU) 10 increases the index register INDX 6 by one and the remainder (shown as 'INDX 6 Mod 10' in the drawing) obtained by dividing the INDX 6 by 10 is set to the index register INDX 5. In step 418, it is determined whether INDX 6 is equal to 0. The 'INDX 6=0' condition represents that all code violation (CV) values are respectively accumulated to the code violation (CV) array buffers e6_buf[i] (i=0 to 9). Accordingly, if INDX 6 is not equal to 0, the new code violation (CV) values are accumulated every 100 milliseconds in a sequence of the code violation (CV) array buffers e6_buf[0], e6_buf[1], e6_buf[2], . . . , e6_buf[9].

When the INDX 6 is equal to 0 in step 418, that is, when the code violation (CV) values are accumulated up to the buffer e6_buf[9], central processing unit (CPU) 10 sums up all code violation (CV) values accumulated to the code violation (CV) array buffers e6_buf[i] (i=0 to 9), in step 420. Then, in step 422, central processing unit (CPU) 10 determines whether the sum result is greater than or equal to a predetermined e7_detect limit value. If the sum result is greater than or equal to the predetermined e7_detect limit value, the sum value is substituted with the value '1550' in step 424, and then the substituted sum value is accumulated to the upper code violation (CV) array buffer e7_buf[0] among e7_buf[i] (i=0 to 9) in step 426. However, if the sum value is less than the predetermined e7_detect limit value in step 422, step 426 is performed without step 424. Then, in step 428, central processing unit (CPU) 10 increases the index register INDX 7 by one, and the remainder (shown 'INDX 7 Mod 10' in the drawing) obtained by dividing the INDX 7 by 10 is again set to the index register INDX 7. In step 430, it is determined whether the INDX 7 is equal to 0.

It can be appreciated from an understanding of the above description that the code violation (CV) values are stored in the corresponding code violation (CV) array buffers according to a rule. Steps 400 to 406 show that the code violation (CV) values are sequentially accumulated to the buffers e5_buf[i] (i=0 to 9). Steps 408 to 418 show that the sum values of the buffers e5_buf[i] (i=0 to 9) are sequentially accumulated to the buffers e6_buf[i] (i=0 to 9). Steps 420 to 430 show that the sum values of the buffers e6_buf[i] (i=0 to 9) are sequentially accumulated to the buffers e7_buf[i] (i=0 to 9). Accordingly, it is shown in steps 431 to 442 that the sum values of the buffers e7_buf[i] (i=0 to 9) are sequentially accumulated to the buffers e8_buf[i] (i=0 to 9). It is shown in steps 444 to 454 that the sum values of the buffers e8_buf[i] (i=0 to 9) are sequentially accumulated to the buffers e9_buf[i] (i=0 to 9). It is shown in steps 456 to 464 that the sum values of the buffers e9_buf (i=0 to 9) are sequentially accumulated to the buffers e10_buf[i] (i=0 to 9). Note that the flow chart of FIGS. 4A to 4C re-starts upon ending in order to completely fill all buffers with code violation (CV) values.

Figure 5:
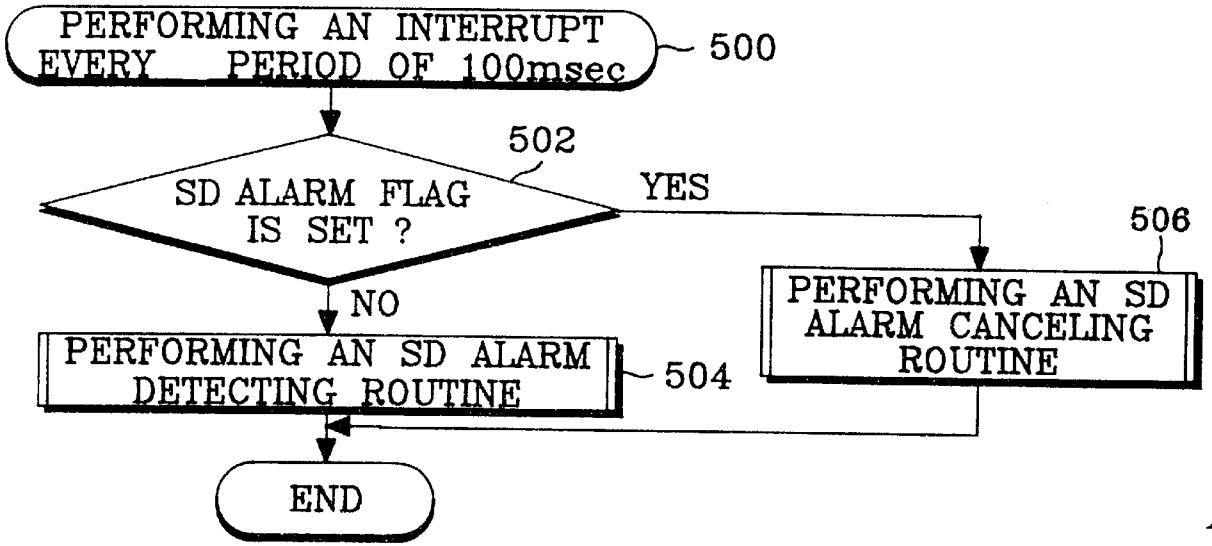
FIG. 5 is a flow chart illustrating the steps for performing signal degradation (SD) alarm detection and cancellation according to the principles of the present invention.

The monitoring and switching unit (MSU) 4 performs the operation corresponding to steps 100 to 104 of FIG. 8 by the operation of FIG. 4, and then performs the operation of the signal degradation (SD) alarm detection and cancellation of FIG. 5. Referring to FIG. 5, in step 500, monitoring and switching unit (MSU) 4 performs the interrupt every period of 100 milliseconds, and then checks whether the signal degradation (SD) alarm flag of the database is set in step 502. If the signal degradation (SD) alarm flag is 'reset', monitoring and switching unit (MSU) 4 performs the signal degradation (SD) alarm detection routine in step 504. And, if the signal degradation (SD) alarm flag is 'set', monitoring and switching unit (MSU) 4 performs the signal degradation (SD) alarm cancellation routine in step 506.

Figure 6A:
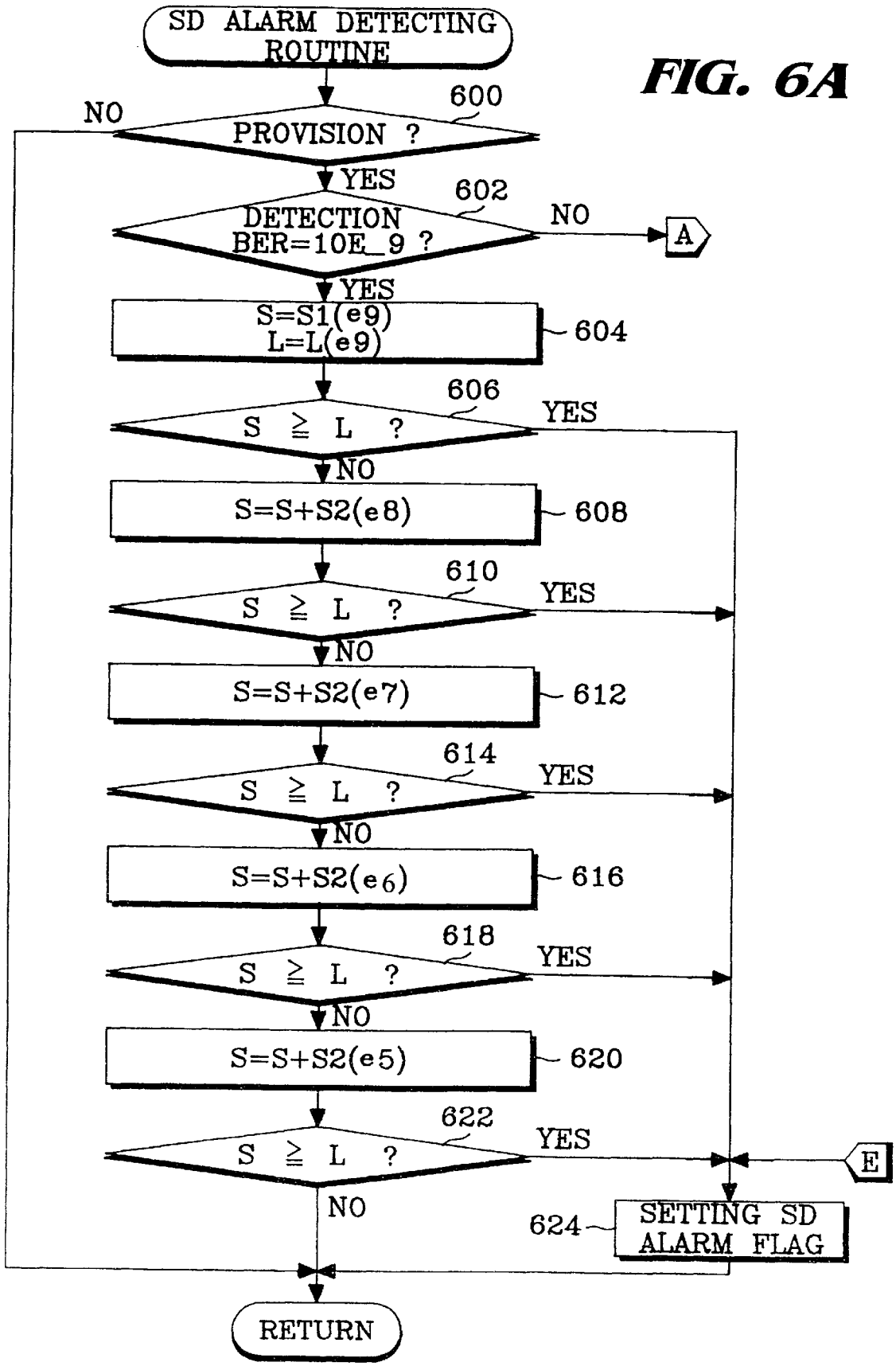
FIGS. 6A through 6C are a flow chart illustrating the sub-steps for performing signal degradation (SD) alarm detection according to FIG. 5.
Figure 6B:
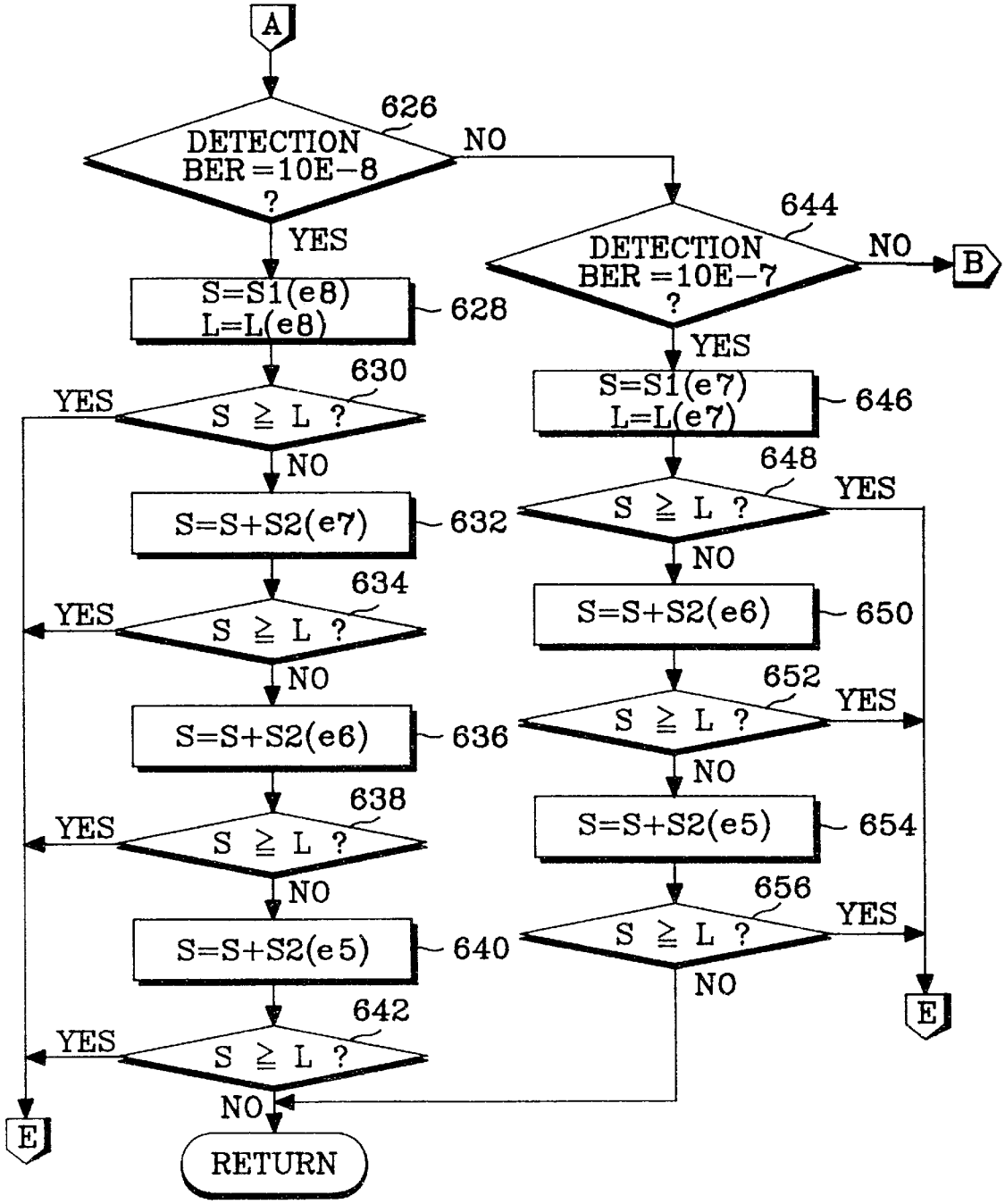
Figure 6C:
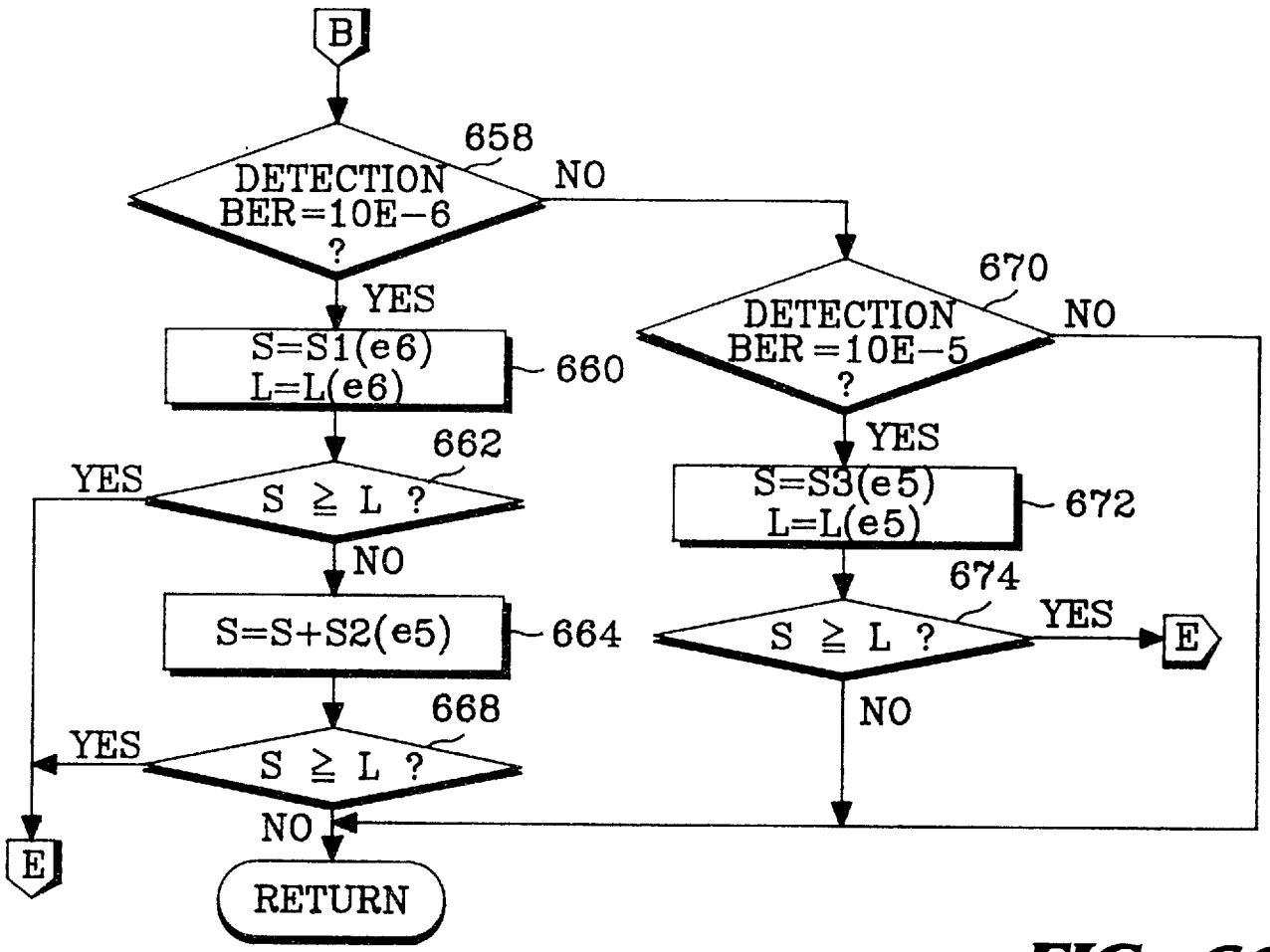
Figure 7A:
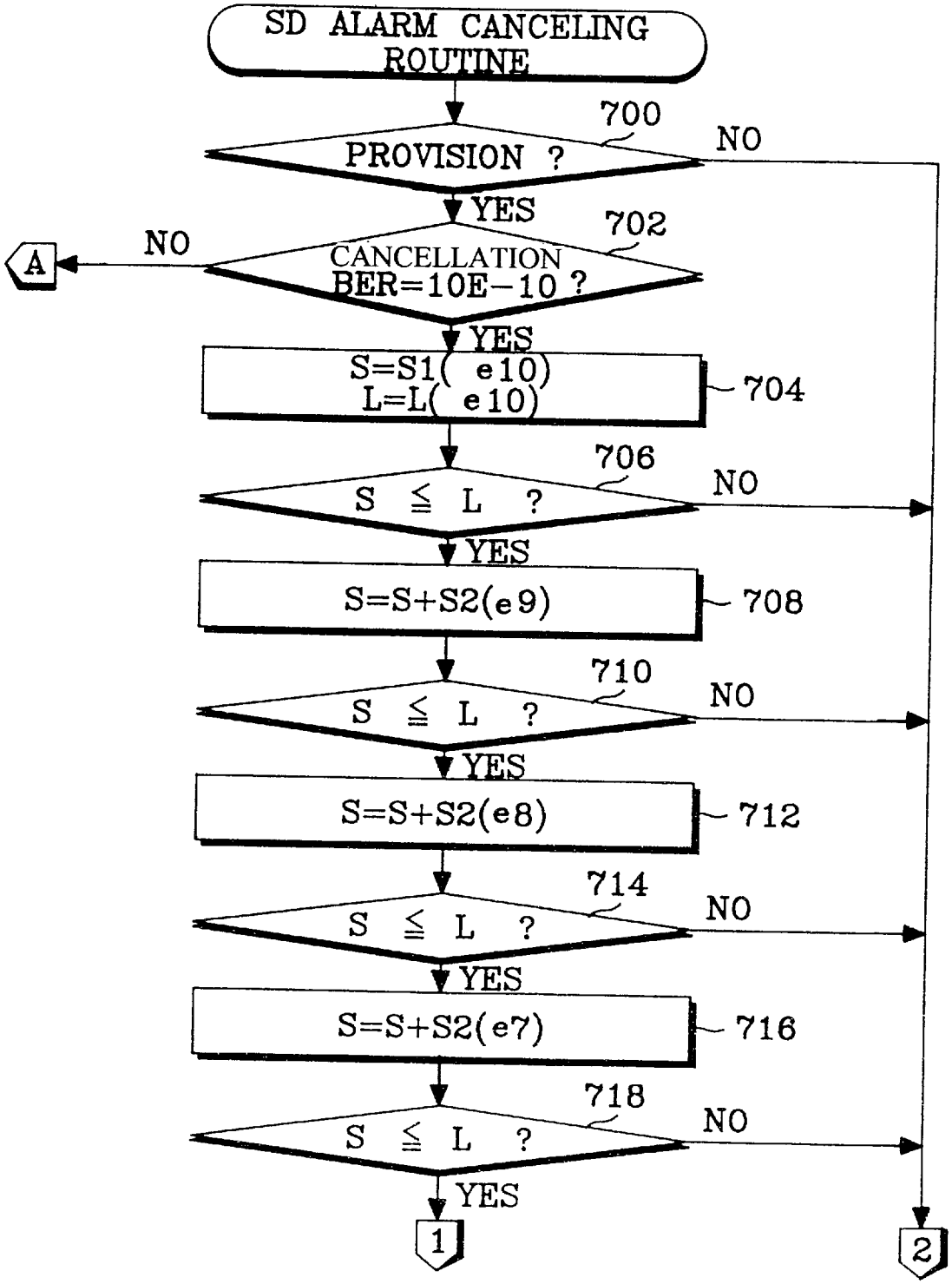
FIGS. 7A through 7D are a flow chart illustrating the sub-steps for performing signal degradation (SD) alarm cancellation according to FIG. 5.
Figure 7B:
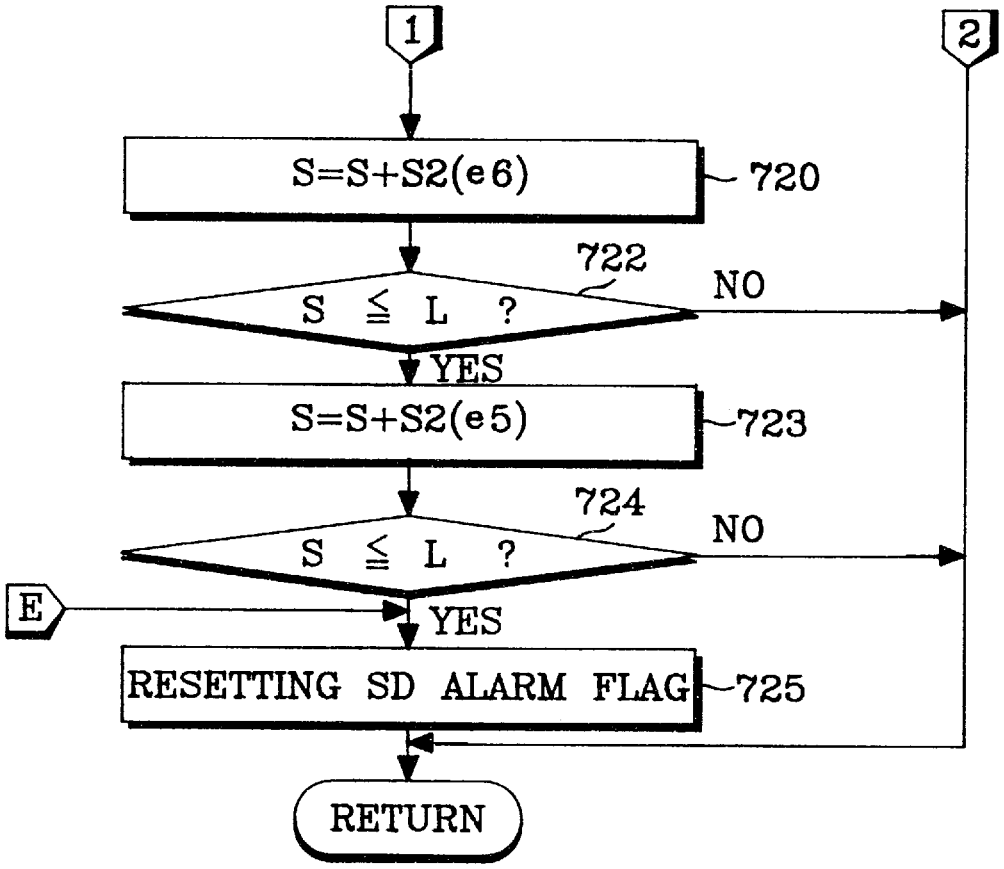
Figure 7C:
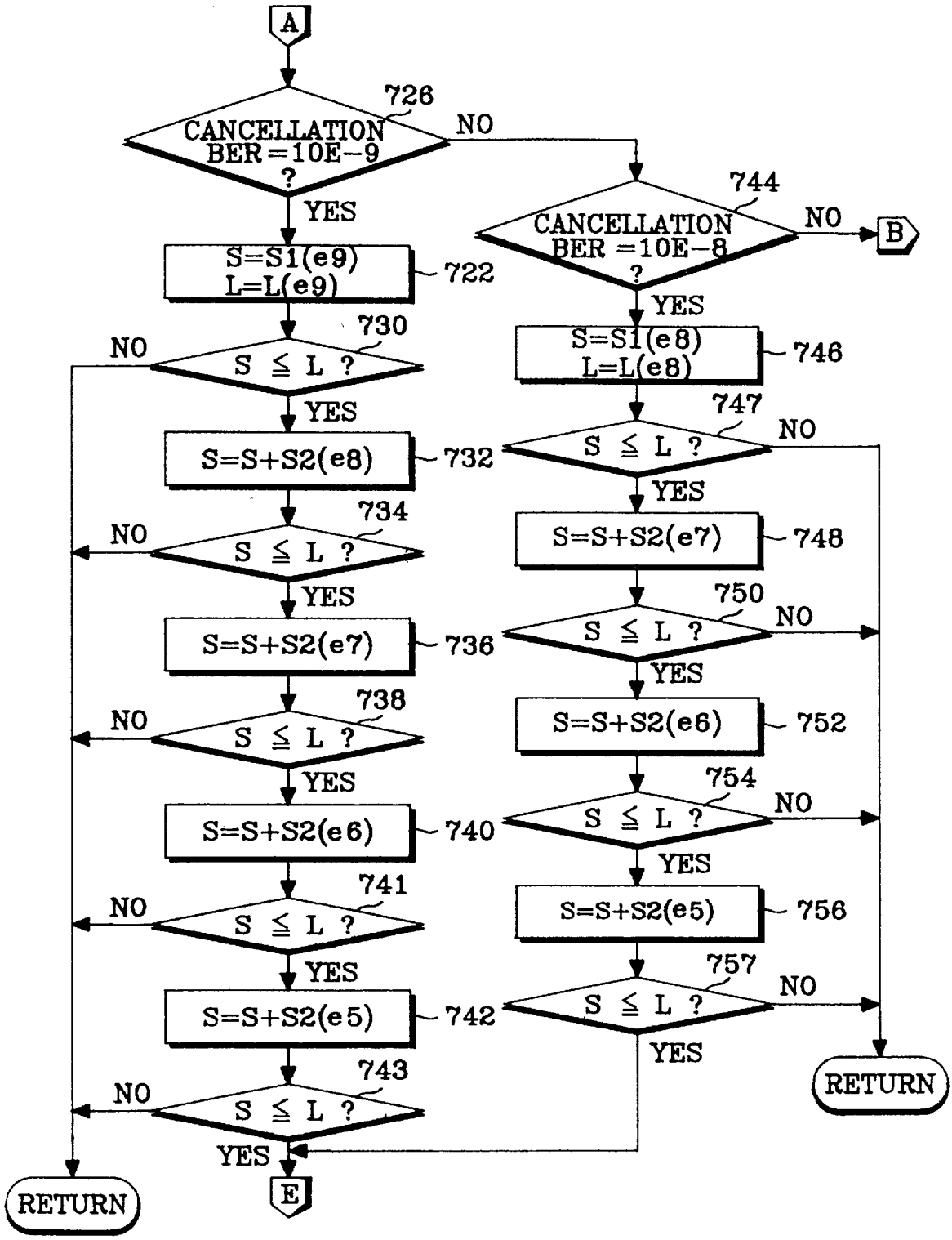
Figure 7D:
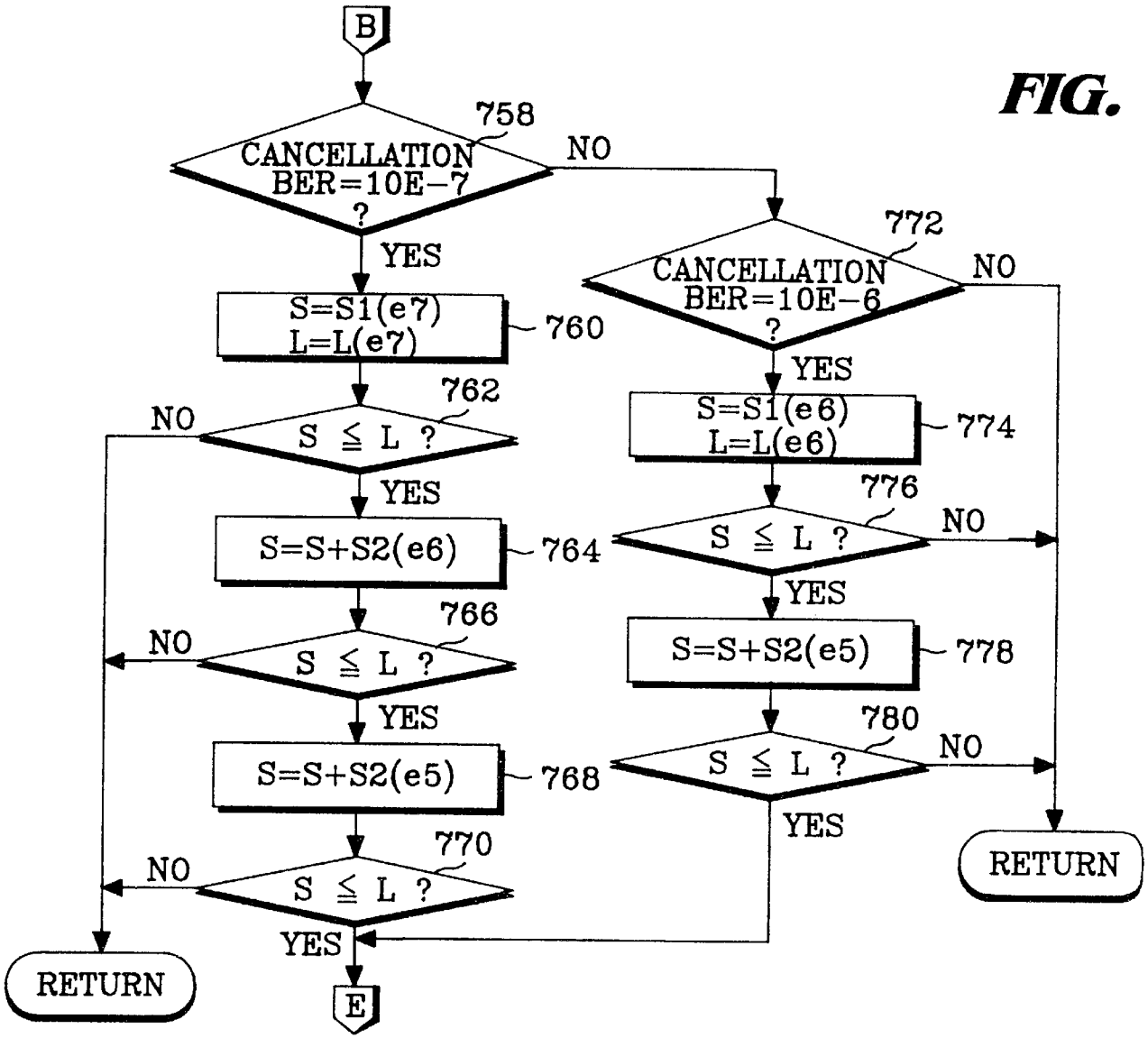

Referring to FIGS. 6A through 6C, the sub-steps for performing signal degradation (SD) alarm detection according to FIG. 5 will now be described.

The sum values S1(x), S2(x) and S3(x) shown in FIGS. 6A through 7D are defined as follows.

$$S1(x) = \sum_{i=0}^{9} Bx[i] - Bx[Ix]$$

$$S2(x) = \sum_{i=0}^{Ix>i} Bx[i],$$

$$S3(x) = \sum_{i=0}^{9} Bx[i]$$

The variable x represents indexes (INDX 5 to INDX 10), and Ix is the value of xth index INDXx. Accordingly, the sum value S1(x) is a value obtained by summing the code violation (CV) values of the buffers ex_buf, except for the buffer ex_buf[i] which the index register INDXx is indicating. The sum value S2(x) is a value obtained by summing the code violation (CV) values of the buffers ex_buf, up to the buffer ex_buf which the index register INDXx is currently indicating. The sum value S3(x) is a total sum value of a certain index register.

Referring to FIGS. 6A through 6C, central processing unit (CPU) 10 of monitoring and switching unit (MSU) 4 determines from main control unit (MCU) 2 whether there is the provision related with the signal degradation (SD) alarm detection in step 600. If the provision exists, central processing unit (CPU) 10 determines whether the detection bit error rate (BER) of a corresponding provision corresponds to any one of 10E-5, 10E-6, 10E-7, . . . , and 10E-9 in steps 602, 626, 644, 658 and 670. At first, however, it is determined whether the detection bit error rate (BER) corresponds to 10E-9 in step 602. If the detection bit error rate (BER) corresponds to the 10E-9, step 604 is performed.

In step 604, central processing unit (CPU) 10 substitutes the sum value S with S1(e9). In other words, the sum value S is as follows.

$$S = S1(e9) = \sum_{i=0}^{9} B(e9)[i] - B(e9)[Ix]$$

The sum value S is obtained by summing the code violation (CV) values of the code violation (CV) array buffers e9_buf[i] (i=0 to 9), except for the code violation (CV) value of the code violation (CV) array buffer e9_buf [5] which the index register INDX 9 is indicating.

An example of calculating the sum value S will now be provided with reference to FIG. 3. Since INDX 9 is indicating the buffer e9_buf[5], that is, the value of Ix is the code violation (CV) value of the buffer e9_buf[5], the code violation (CV) values of the buffers e9_buf[i] (i=0 to 4, 6 to 9) except for the buffer e9_buf[5] are summed. Accordingly, the sum value S is the code violation (CV) value corresponding to 9000 seconds of detection time. At this time, it should be noted that the latest code violation (CV) value is stored in the buffer e9_buf[4], and the oldest code violation (CV) value is stored in the buffer e9_buf[6].

Also, in step 604, a limit value L is set as an e9 limit value L(e9) corresponding to numbers (=1536)×10 of a detection bit error rate (BER) of 10E-9 illustrated in Table 1.

Central processing unit (CPU) 10 compares the sum value S with the limit value L in step 606. If the sum value S is greater than or equal to the limit value L, the signal degradation (SD) alarm flag is set in step 624. However, if the sum value S is less than the limit value L, the sum values S(e8), S(e7), . . . , S(e5) should also be considered. Accordingly, if the sum value S is less than the limit value L, step 608 is performed.

The sum value S is substituted as S=S+S2(e8) in step 608. In other words, the sum value S is as follows.

$$S = S1(e9) + \sum_{i=0}^{Ix>i} B(e8)[i]$$

As appreciated from the above, the sum value S is obtained by summing the code violation (CV) values of e8_buf up to the buffer e8_buf[i] (for example, i=0 of FIG. 3) which the index register INDX 8 is indicating, and adding this sum to the value S1(e9). Central processing unit (CPU) 10 then compares the sum value S obtained in step 608 with the limit value L, in step 610. At this time, the sum value S is the code violation (CV) value corresponding to 9000 seconds of detection time. If the sum value S is greater than or equal to the limit value L, the signal degradation (SD) alarm flag is set in step 624. However, if the sum value S is less than the limit value L, step 612 is performed.

In step 612, the sum value S is substituted with S+S2(e7). In other words, the sum value S is obtained by adding $$\sum_{i=0}^{Ix>i} B(e7)[i]$$

to the sum value S of step 608. The value represented by $$\sum_{i=0}^{Ix>i} B(e7)[i]$$

is obtained by summing the code violation (CV) values of e7_buf up to the buffer e7_buf[i] (for example, i=4 in FIG. 3) which the index register INDX 7 is indicating. Central processing unit (CPU) 10 then compares the sum value S obtained in step 612 with the limit value L, in step 614. At this time, the sum value S is the code violation (CV) value corresponding to 9040 seconds of detection time. If the sum value S is greater than or equal to the limit value L in step 614, the signal degradation (SD) alarm flag is set in step 624. However, if the sum value S is less than the limit value L, step 616 is performed.

In step 616, the sum value S is substituted with S+S2(e6). In other words, the sum value S is obtained by adding $$\sum_{i=0}^{Ix>i} B(e6)[i]$$

to the sum value S of step 612. The value represented by $$\sum_{i=0}^{Ix>i} B(e6)[i]$$

is obtained by summing the code violation (CV) values of e6_buf up to the buffer e6_buf[i] (for example, i=2 in FIG. 3) which the index register INDX 6 is indicating. Central processing unit (CPU) 10 then compares the sum value S obtained in step 616 with the limit value L, in step 618. At this time, the sum value S is the code violation (CV) value corresponding to 9042 seconds of detection time. If the sum value S is greater than or equal to the limit value L, the signal degradation (SD) alarm flag is set in step 624. However, if the sum value S is less than the limit value L, step 620 is performed.

In step 620, the sum value S is substituted with S+S2(e5). In other words, the sum value S is obtained by adding $$\sum_{i=0}^{Ix>i} B(e5)[i]$$

to the sum value S of step 616. The value represented by $$\sum_{i=0}^{Ix>i} B(e5)[i]$$

is obtained by summing the code violation (CV) values of e5_buf up to the buffer e5_buf[i] (for example, i=9 in FIG. 3) which the index register INDX 5 is indicating. Central processing unit (CPU) 10 then compares the sum value S obtained in step 616 with the limit value L, in step 622. At this time, the sum value S is the code violation (CV) value corresponding to 9042.9 seconds of detection time. If the sum value S is greater than or equal to the limit value L, the signal degradation (SD) alarm flag is set in step 624. However, if the sum value S is less than the limit value L, a return step is performed.

Steps 626 to 642 show the signal degradation (SD) alarm detection operation when the provision (the detection bit error rate (BER)) related with the signal degradation (SD) alarm detection corresponds to 10E-8. Steps 626 to 642 will be easily understood by referring to the above described operation of steps 600 to 624. In the same manner, steps 644 to 656 show the signal degradation (SD) alarm detection operation when the provision (the detection bit error rate (BER)) related with the signal degradation (SD) alarm detection corresponds to 10E-7. Steps 658 to 668 show the signal degradation (SD) alarm detection operation when the provision (the detection bit error rate (BER)) related with the signal degradation (SD) alarm detection corresponds to 10E-6. Steps 670 to 674 show the signal degradation (SD) alarm detection operation when the provision (the detection bit error rate (BER)) related with the signal degradation (SD) alarm detection corresponds to 10E-5.

The 'set' status of the signal degradation (SD) alarm flag in the above operation is represented in the signal degradation (SD) alarm flag region of the database illustrated in FIG. 3.

Next, the operation of resetting the signal degradation (SD) alarm flag will be described with reference to FIGS. 7A through 7D. The operation of resetting the signal degradation (SD) alarm flag is similar to the operation of setting the signal degradation (SD) alarm flag. With resetting, however, the provision is based on the code violation (CV) array buffers e10_buf[i] (i=0 to 9) which are installed for checking the cancellation condition. From Table 1, the provision detection bit error rate (BER) of 10E-5 corresponds to the cancellation bit error rate (BER) of 10E-6, the detection bit error rate (BER) of 10E-6 corresponds to the cancellation bit error rate (BER) of 10E-7, the detection bit error rate (BER) of 10E-7 corresponds to the cancellation bit error rate (BER) of 10E-8, the detection bit error rate (BER) of 10E-8 corresponds to the cancellation bit error rate (BER) of 10E-9, and the detection bit error rate (BER) of 10E-9 corresponds to the cancellation bit error rate (BER) of 10E-10. Accordingly, if the provision (detection bit error rate (BER)) is set to 10E-5 by the operator, the cancellation bit error rate (BER) is set to 10E-6.

Accordingly, central processing unit (CPU) 10 of the monitor and switching unit (MSU) 4 determines whether there is a provision related with the signal degradation (SD) alarm cancellation in step 700. If the provision exists, central processing unit (CPU) 2 determines whether the cancellation bit error rate (BER) of a corresponding provision corresponds to any one of 10E-6, 10E-7, . . . , and 10E-10 in steps 702, 726, 744, 758 and 772. At first, central processing unit (CPU) 10 determines whether the cancellation bit error rate (BER) corresponds to 10E-10 in step 702. If the cancellation bit error rate (BER) corresponds to 10E-10, step 704 is performed.

In step 704, the sum value S is substituted with S1(e10) by central processing unit (CPU) 10. In other words, the sum value S is as follows.

$$S = S1(e10) = \sum_{i=0}^{9} B(e10)[i] - B(e10)[Ix]$$

The sum value S is obtained by summing the code violation (CV) values of the code violation (CV) array buffers e10_buf[i] (i=0 to 9), except for the code violation (CV) value of the code violation (CV) array buffer e10_buf[7] which the index register INDX 10 is indicating.

An example for calculating the sum value S will now be described with reference to FIG. 3. Since the INDX 10 is indicating the buffer e10_buf[7], that is, the value of Ix is the code violation (CV) value of the buffer e10_buf[7], the code violation (CV) values of the buffers e10_buf[i] (i=0 to 6, 8 to 9) except for the buffer e10_buf[7] are summed up. Accordingly, the sum value S is the code violation (CV) value corresponding to 90000 seconds of detection time. At this time, it should be noted that the latest code violation (CV) value is stored in the buffer e10_buf[6], and the oldest code violation (CV) value is stored in the buffer e10_buf[8].

Also, in step 704, the limit value L is set as an e10 limit value L(e10) corresponding to numbers (=1536)×10 of a cancellation bit error rate (BER) of the 10E-10 condition illustrated in Table 1.

Central processing unit (CPU) 10 compares the sum value S with the limit value L in step 706. If the sum value S is larger than the limit value L, the return step is performed since the signal degradation (SD) alarm flag is in the set state. However, if the sum value S is less than or equal to the limit value L, the sum values S(e9), S(e8), . . . , S(e5) should also be considered. Accordingly, if the sum value S is less than or equal to the limit value L, step 708 is performed.

At first, the sum value S is substituted as S=S+S2(e9) in step 708. In other words, the sum value S is as follows.

$$S = S1(e10) = \sum_{i=0}^{Ix>i} B(e9)[i]$$

As appreciated from the above, the sum value S is obtained by summing the code violation (CV) values of e9_buf up to the buffer e9_buf[i] (for example, i=5 of FIG. 3) which the index register INDX 9 is indicating, and adding this sum to the value S1(e10). Central processing unit (CPU) 10 then compares the sum value S obtained in the step 708 with the limit value L, in step 710. At this time, the sum value S is the code violation (CV) value corresponding to 95000 seconds of detection time. If the sum value S is larger than the limit value L, the return step is performed since the signal degradation (SD) alarm flag is in the set state. However, if the sum value S is less than or equal to the limit value L, step 712 is performed.

In step 712, the sum value S is substituted with S+S2(e8). In other words, the sum value S is obtained by adding $$\sum_{i=0}^{Ix>i} B(e8)[i]$$

to the sum value S of step 708. The value represented by $$\sum_{i=0}^{Ix>i} B(e8)[i]$$

is obtained by summing the code violation (CV) values of e8_buf up to the buffer e8_buf[i] (for example, i=0 of FIG. 3) which the index register INDX 8 is indicating. Central processing unit (CPU) 10 then compares the sum value S obtained in step 712 with the limit value L, in step 714. At this time, the sum value S is the code violation (CV) value corresponding to 95000 seconds of detection time. If the sum value S is larger than the limit value L, the return step is performed since the signal degradation (SD) alarm flag is in the set state. However, if the sum value S is less than or equal to the limit value L, step 716 is performed.

In step 716, the sum value S is substituted with S+S2(e7). In other words, the sum value S
is obtained by adding $$\sum_{i=0}^{Ix>i} B(e7)[i]$$

to the sum value S of step 712. The value represented by $$\sum_{i=0}^{Ix>i} B(e7)[i]$$

is obtained by summing the code violation (CV) values of e7_buf up to the buffer e7_buf[i] (for example, i=4 of FIG. 3) which the index register INDX 7 is indicating. Central processing unit (CPU) 10 then compares the sum value S obtained in step 716 with the limit value L, in step 718. At this time, the sum value S is the code violation (CV) value corresponding to 95040 seconds of detection time. If the sum value S is larger than the limit value L, the return step is performed since the signal degradation (SD) alarm flag is in the set state. However, if the sum value S is less than or equal to the limit value L, step 720 is performed.

In step 720, the sum value S is substituted with S+S2(e6). In other words, the sum value S is obtained by adding $$\sum_{i=0}^{Ix>i} B(e6)[i]$$

to the sum value S of step 716. The value represented by $$\sum_{i=0}^{Ix>i} B(e6)[i]$$

is obtained by summing the code violation (CV) values of e6_buf up to the buffer e6_buf[i] (for example, i=2 of FIG. 3) which the index register INDX 6 is indicating. Central processing unit (CPU) 10 then compares the sum value S obtained in step 720 with the limit value L, in step 722. At this time, the sum value S is the code violation (CV) value corresponding to 95042 seconds of detection time. If the sum value S is larger than the limit value L, the return step is performed since the signal degradation (SD) alarm flag is in the set state. However, if the sum value S is less than or equal to the limit value L, step 723 is performed.

In step 723, the sum value S is substituted with S+S2(e5). In other words, the sum value S is obtained by adding $$\sum_{i=0}^{Ix>i} B(e5)[i]$$

to the sum value S of step 720. The value represented by $$\sum_{i=0}^{Ix>i} B(e5)[i]$$

is obtained by summing the code violation (CV) values of e5_buf up to the buffer e5_buf[i] (for example, i=9 of FIG. 3) which the index register INDX 5 is indicating. Central processing unit (CPU) 10 then compares the sum value S obtained in step 723 with the limit value L, in step 724. At this time, the sum value S is the code violation (CV) value corresponding to 95042.9 seconds of detection time. If the sum value S is larger than the limit value L, the return step is performed since the signal degradation (SD) alarm flag is in the set state. However, if the sum value S is less than or equal to the limit value L, it is determined that the signal degradation (SD) alarm is canceled. Accordingly, the signal degradation (SD) alarm flag is reset in step 725.

Steps 726 to 743 show the signal degradation (SD) alarm cancellation operation when the provision (the cancellation bit error rate (BER)) related with the signal degradation (SD) alarm cancellation corresponds to 10E-9. Steps 726 to 743 will be easily understood, referring to the above described cancellation operation of steps 700 to 725. In the same manner, steps 744 to 757 show the signal degradation (SD) alarm cancellation operation when the provision (the cancellation bit error rate (BER)) related with the signal degradation (SD) alarm cancellation corresponds to 10E-8. Steps 758 to 770 show the signal degradation (SD) alarm cancellation operation when the provision (the cancellation bit error rate (BER)) related with the signal degradation (SD) alarm cancellation corresponds to 10E-7. Steps 772 to 780 show the signal degradation (SD) alarm cancellation operation when the provision (the cancellation bit error rate (BER)) related with the signal degradation (SD) alarm cancellation corresponds to 10E-6. Steps 772 to 780 will be easily understood, referring to the above described cancellation operation of steps 700 to 725. The signal degradation (SD) alarm flag is represented in the database region as shown in FIG. 3.

As described above, the method for signal degradation (SD) alarm detection and cancellation according to the present invention has an advantage in that memory consumption is reduced in a digital microwave system.

While there have been illustrated and described what are considered to be preferred embodiments of the present invention, it will be understood by those skilled in the art that various changes and modifications may be made, and equivalents may be substituted for elements thereof without departing from the true scope of the present invention.

What is claimed is:

1. A method for signal degradation alarm detection and cancellation in a digital microwave system, comprising the steps of:

performing an interrupt every minimum period defined in a provision to store code violation values detected from tributary units in first buffers every said minimum period;

when said first buffers are filled with said code violation values, summing said code violation values to obtain first code violation sum values and storing said first code violation sum values in second buffers, each one of said first code violation sum values being obtained according to a first time period equal to a first integer multiple of said minimum period;

when said second buffers are filled with said first code violation sum values, summing said first code violation sum values to obtain second code violation sum values and storing said second code violation sum values in third buffers, each one of said second code violation sum values being obtained according to a second time period equal to a second integer multiple of said minimum period;

when said third buffers are filled with said second code violation sum values, summing said second code violation sum values to obtain third code violation sum values and storing said third code violation sum values in fourth buffers, each one of said third code violation sum values being obtained according to a third time period equal to a third integer multiple of said minimum period;

when said fourth buffers are filled with said third code violation sum values, summing said third code violation sum values to obtain fourth code violation sum values and storing said fourth code violation sum values in fifth buffers, each one of said fourth code violation sum values being obtained according to a fourth time period equal to a fourth integer multiple of said minimum period;

when said fifth buffers are filled with said fourth code violation sum values, summing said fourth code violation sum values to obtain fifth code violation sum values and storing said fifth code violation sum values in sixth buffers, each one of said fifth code violation sum values being obtained according to a fifth time period equal to a fifth integer multiple of said minimum period; and performing said signal degradation alarm detection and cancellation by comparing modified sum values generated from said first, second, third, fourth and fifth code violation sum values with a predetermined limit value.

2. The method as claimed in claim 1, wherein said minimum period equals 100 milliseconds.

3. The method as claimed in claim 2, wherein said first integer equals 10.

4. The method as claimed in claim 3, wherein said second integer equals 100.

5. The method as claimed in claim 4, wherein said third integer equals 1,000.

6. The method as claimed in claim 5, wherein said fourth integer equals 10,000.

7. The method as claimed in claim 6, wherein said fifth integer equals 100,000.

8. A method for managing a database, comprising the steps of:

performing an interrupt every minimum period defined in a provision to store code violation values detected from tributary units in first buffers every said minimum period;

when said first buffers are filled with said code violation values, summing said code violation values to obtain first code violation sum values and storing said first code violation sum values in second buffers;

when said second buffers are filled with said first code violation sum values, summing said first code violation sum values to obtain second code violation sum values and storing said second code violation sum values in third buffers;

when said third buffers are filled with said second code violation sum values, summing said second code violation sum values to obtain third code violation sum values and storing said third code violation sum values in fourth buffers;

when said fourth buffers are filled with said third code violation sum values, summing said third code violation sum values to obtain fourth code violation sum values and storing said fourth code violation sum values in fifth buffers; and when said fifth buffers are filled with said fourth code violation sum values, summing said fourth code violation sum values to obtain fifth code violation sum values and storing said fifth code violation sum values in sixth buffers.

9. The method as claimed in claim 8, wherein when one of said first code violation sum values is greater than or equal to a code violation detection limit value, said one of said first code violation sum values is substituted with a specific value.

10. The method as claimed in claim 9, wherein said specific value is 1550.

11. The method as claimed in claim 8, wherein when one of said second code violation sum values is greater than or equal to a code violation detection limit value, said one of said second code violation sum values is substituted with a specific value.

12. The method as claimed in claim 11, wherein said specific value is 1550.

13. The method as claimed in claim 8, wherein when one of said third code violation sum values is greater than or equal to a code violation detection limit value, said one of said third code violation sum values is substituted with a specific value.

14. The method as claimed in claim 13, wherein said specific value is 1550.

15. The method as claimed in claim 8, wherein when one of said fourth code violation sum values is greater than or equal to a code violation detection limit value, said one of said fourth code violation sum values is substituted with a specific value.

16. The method as claimed in claim 15, wherein said specific value is 1550.

17. The method as claimed in claim 8, wherein when one of said fifth code violation sum values is greater than or equal to a code violation detection limit value, said one of said fifth code violation sum values is substituted with a specific value.

18. The method as claimed in claim 17, wherein said specific value is 1550.

19. A method for signal degradation alarm detection in a digital microwave system, comprising the steps of:

summing code violation values from cells of a given buffer except for one of said cells currently indicated in said given buffer to calculate a code violation sum value of a corresponding provision, and setting a code violation limit value to a previously defined value;

comparing said code violation sum value with said code violation limit value;

setting a signal degradation alarm flag to detect an alarm when said code violation sum value is greater than or equal to said code violation limit value;

adding said code violation sum value to a next code violation sum value of a lower buffer to obtain a new code violation sum value when said code violation sum value is less than said code violation limit value;

setting said signal degradation alarm flag to detect said alarm when said new code violation sum value is greater than or equal to said code violation limit value; and ending performance of said method without setting said signal degradation alarm flag when a final code violation sum value corresponding to a lowermost buffer is less than said code violation limit value.

20. A method for signal degradation alarm cancellation in a digital microwave system, comprising the steps of:

summing code violation values from cells of a given buffer except for one of said cells currently indicated in said given buffer to calculate a code violation sum value of a corresponding provision, and setting a code violation limit value to a previously defined value;

comparing said code violation sum value with said code violation limit value;

ending performance of said method without executing said signal degradation alarm cancellation when said code violation sum value is greater than said code violation limit value;

adding said code violation sum value to a next code violation sum value corresponding to a lower buffer to obtain a new code violation sum value when said code violation sum value is less than or equal to said code violation limit value;

ending performance of said method without executing said signal degradation alarm cancellation when said new code violation sum value is greater than said code violation limit value; and resetting a signal degradation alarm flag to execute said signal degradation alarm cancellation when a final code violation sum value corresponding to a lowermost buffer is less than or equal to said code violation limit value.

21. A database for a digital microwave system which collects code violation values, said database comprising:

a plurality of buffers, each comprised of ten buffer cells, for storing said code violation values;

a signal degradation alarm flag buffer for indicating a status of signal degradation alarm detection and cancellation based on the code violation values stored in said buffers; and a plurality of index registers respectively corresponding to said plurality of buffers, each one of said index registers indicating one of said buffer cells within a corresponding one of said buffers in which a current one of said code violation values is stored.

22. A method for signal degradation alarm detection and cancellation in a digital microwave system, comprising the steps of:

(a) performing an interrupt every minimum period defined in a provision to store code violation values detected from tributary units in first buffers every said minimum period;

(b) when said first buffers are filled with said code violation values, summing said code violation values to obtain first code violation sum values and storing said first code violation sum values in second buffers, each one of said first code violation sum values being obtained according to a first time period equal to a first integer multiple of said minimum period;

(c) repeating said step (b) for said second buffer and additional buffers so as to obtain additional code violation sum values and store said additional code violation sum values in said additional buffers, each one of said additional code violation sum values being obtained according to an additional time period equal to an additional integer multiple of said minimum period; and (d) performing said signal degradation alarm detection and cancellation by comparing modified sum values generated from said first and additional code violation sum values with a predetermined limit value.

23. The method as claimed in claim 22, wherein said minimum period equals 100 milliseconds.

24. The method as claimed in claim 23, wherein one of said additional integers equals 10.

25. The method as claimed in claim 24, wherein one of said additional integers equals 100.

26. The method as claimed in claim 25, wherein one of said additional integers equals 1,000.

27. The method as claimed in claim 26, wherein one of said additional integers equals 10,000.

28. The method as claimed in claim 27, wherein one of said additional integers equals 100,000.

29. A method for managing a database, comprising the steps of:

(a) performing an interrupt every minimum period defined in a provision to store code violation values detected from tributary units in first buffers every said minimum period;

(b) when said first buffers are filled with said code violation values, summing said code violation values to obtain first code violation sum values and storing said first code violation sum values in second buffers; and (c) repeating said step (b) for said second buffers and additional buffers so as to obtain additional code violation sum values and storing said additional code violation sum values in additional buffers.

30. The method as claimed in claim 29, wherein when one of said first code violation sum values is greater than or equal to a code violation detection limit value, said one of said first code violation sum values is substituted with a specific value.

31. The method as claimed in claim 30, wherein said specific value is 1550.

32. The method as claimed in claim 29, wherein when one of said additional code violation sum values is greater than or equal to a code violation detection limit value, said one of said additional code violation sum values is substituted with a specific value.

33. The method as claimed in claim 32, wherein said specific value is 1550.

* * * * *